US007358918B2

(12) United States Patent
Itsuji

(10) Patent No.: US 7,358,918 B2
(45) Date of Patent: Apr. 15, 2008

(54) PLANAR ANTENNA APPARATUS

(75) Inventor: Takeaki Itsuji, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/230,821

(22) Filed: Sep. 21, 2005

(65) Prior Publication Data

US 2006/0061510 A1 Mar. 23, 2006

(30) Foreign Application Priority Data

Sep. 21, 2004 (JP) ..... 2004-272676
Mar. 17, 2005 (JP) ..... 2005-077213

(51) Int. Cl.
*H01Q 13/00* (2006.01)
*H01Q 1/38* (2006.01)

(52) U.S. Cl. ..... 343/772; 343/700 MS

(58) Field of Classification Search ..... 343/700 MS, 343/795, 845, 846, 772
See application file for complete search history.

(56) References Cited

U.S. PATENT DOCUMENTS 6,259,407 B1 * 7/2001 Tran ..... 343/700 MS
6,448,553 B1 9/2002 Itsuji et al. ..... 250/306
6,753,746 B2 * 6/2004 Lin et al. ..... 333/246
6,835,925 B2 12/2004 Itsuji et al. ..... 250/234
7,183,977 B2 * 2/2007 Suh ..... 343/700 MS
2006/0085159 A1 4/2006 Itsuji et al. ..... 702/150
2007/0030115 A1 2/2007 Itsuji et al. ..... 340/5.8

FOREIGN PATENT DOCUMENTS

JP 1-300701 12/1989

OTHER PUBLICATIONS

Takuya Taniguchi et al., "Antenna Development For Ultra Wideband Measurement Applications", Technical Report Of IEICE, WBS2003-12, MW2003-24 (May 2003). (w/abstract).
U.S. Appl. No. 10/587,262 (Takeaki Itsuji), pending.

* cited by examiner

*Primary Examiner*—Shih-Chao Chen
(74) *Attorney, Agent, or Firm*—Fitzpatrick, Cella, Harper & Scinto

(57) ABSTRACT

An antenna apparatus including a dielectric substrate, a planar antenna element disposed on the substrate, and a waveguide for propagating electromagnetic waves to or from the planar antenna element. The waveguide includes at least a first conductor and a second conductor extending along each other. Near a connection portion formed between the first and second conductors and the planar antenna element, there is provided a taper region in which a distance between mutually-facing edge portions of the first conductor and the second conductor increases approximately monotonically toward the planar antenna element.

8 Claims, 20 Drawing Sheets

FREQUENCY [GHz]
DEPENDENCY ON DISTANCE d
BETWEEN ANTENNA AND GROUND
(H: 6.0 mm θ: 90° a: 8.4 mm W: 2.0 mm G: 0.6 mm ϕ: — L: —)

RELATIONSHIP BETWEEN SWR AND DISTANCE d BETWEEN ANTENNA AND GROUND
(H: 6.0 mm θ: 90° a: 8.4 mm W: 2.0 mm G: 0.6 mm ϕ: — L: —)

DEPENDENCY ON HEIGHT L OF TAPER REGION
(H: 6.0 mm θ: 90° a: 8.4 mm W: 2.0 mm G: 0.6 mm ϕ: 45° d: 0.5 mm)

RELATIONSHIP BETWEEN SWR
AND HEIGHT L OF TAPER REGION
(H: 6.0 mm θ: 90° a: 8.4 mm W: 2.0 mm G: 0.6 mm ϕ: 45° d: 0.5 mm)

DEPENDENCY ON ANGLE ϕ OF TAPER REGION
(H: 6.0 mm θ: 90° a: 8.4 mm W: 2.0 mm G: 0.6 mm d: 0.5 mm L: 0.7 mm)

RELATIONSHIP BETWEEN SWR
AND ANGLE ϕ OF TAPER REGION
(H: 6.0 mm θ: 90° a: 8.4 mm W: 2.0 mm G: 0.6 mm d: 0.5 mm L: 0.7 mm)

RELATIONSHIP BETWEEN SWR AND DISTANCE d BETWEEN ANTENNA AND GROUND
(H: 25.0 mm θ: 90° a: 14.4 mm W: 2.0 mm G: 0.6 mm ϕ: — L: —)

DEPENDENCY ON HEIGHT L OF TAPER REGION
(H: 25.0 mm θ: 90° a: 14.4 mm W: 2.0 mm G: 0.6 mm ϕ: 45° d: 0.5 mm)

RELATIONSHIP BETWEEN SWR
AND HEIGHT L OF TAPER REGION
(H: 25.0 mm θ: 90° a: 14.4 mm W: 2.0 mm G: 0.6 mm ϕ: 45° d: 0.5 mm)

DEPENDENCY ON ANGLE ϕ OF TAPER REGION
(H: 25.0 mm θ: 90° a: 14.4 mm W: 2.0 mm G: 0.6 mm d: 0.5 mm L: 1.0 mm)

RELATIONSHIP BETWEEN SWR
AND ANGLE ϕ OF TAPER REGION
(H: 25.0 mm θ: 90° a: 14.4 mm W: 2.0 mm G: 0.6 mm d: 0.5 mm L: 1.0 mm)

PLANAR ANTENNA APPARATUS

BACKGROUND OF THE INVENTION

1. Field of the Invention

The present invention relates to a planar antenna apparatus, such as a wideband antenna apparatus, capable of being used in the fields of high precision positional detecting techniques, large capacity fast signal transmission techniques, and the like.

2. Description of the Related Background Art

Conventionally, there has been proposed a planar type antenna apparatus in which a co-planar waveguide 1 is formed on a planar substrate, and a center conductor 1*a* of the co-planar waveguide 1 is shaped into a T-shape at its end portion, as illustrated in FIG. 26. In FIG. 26, reference numeral 1*b* designates a grounded conductor, reference numeral 2 designates a slot, reference numeral 3 designates electric fields, and reference numeral 4 designates a short-circuit line. In the antenna apparatus illustrated in FIG. 26, resonance occurs at a frequency whose half wavelength is equal to the length of the T-shaped conductor (see Japanese Patent Laid-Open No. 1(1989)-300701; Reference 1).

Further, in recent years, in tandem with the high precision positional detecting techniques and large capacity fast signal transmission techniques, ultra wideband (UWB) techniques using a wide frequency region in a range from 3.1 GHz to 10.6 GHz have been energetically developed. When such a wide frequency region is used, the time resolution of a pulse can be improved in positional detecting techniques using a pulse radar, for example, thus allowing high precision positional detection to be achieved.

In connection with signal transmission techniques, usable band width can be widened, and accordingly the throughput of signals is expected to increase.

As an antenna apparatus capable of being used in the above frequency band, a solid teardrop-shaped omni-directional antenna apparatus is known. This antenna apparatus is comprised of a combination of a conical hole structure formed on a ground substrate, and a spherical body disposed on the conical hole structure in an inscribed manner (see Shin-Gaku Technical Report WBS 2003-12, 2003; Reference 2).

Generally, an antenna apparatus is a device for emitting electromagnetic waves carrying signals supplied to the antenna apparatus (transmission) or conversely for taking in and detecting external electromagnetic waves from outside (reception). To transmit the signal supplied to the antenna apparatus with the desirable efficiency, it is generally necessary to match the characteristic impedance of a waveguide connected to an antenna element with the input impedance of the antenna element. When the impedance of the waveguide is matched with the impedance of the antenna element, the signal supplied to the antenna element from the waveguide can be effectively emitted as electromagnetic waves. In contrast, when the impedance of the waveguide is mismatched with the impedance of the antenna element, a portion of the signal supplied from the waveguide is reflected by the antenna element, and the strength of the emitted electromagnetic waves is likely to decrease. Accordingly, the efficiency is reduced. It is known that such reflection of the signal occurs due to an abrupt change in the electromagnetic-field distribution attendant on a discontinuity in the shape of a conductor.

The antenna apparatus disclosed in Reference 1 is a resonant antenna apparatus, i.e., an antenna apparatus that is constructed to be used in a narrow band. In this antenna apparatus, the distance (i.e., the slot 2) between a side portion of the T-shaped conductor and an end portion of the waveguide is adjusted so as to effect desired the impedance matching between the antenna element and the waveguide. Such a method is often used when the impedance matching is carried out in a narrowband antenna apparatus.

However, if that matching method is applied to an antenna apparatus required to have the frequency characteristic in a broad band, an abrupt change in the electromagnetic-field distribution due to the discontinuity of its waveguide is likely to appear at some frequencies. It hence becomes difficult to achieve impedance matching in a broad band.

In contrast, the solid antenna apparatus disclosed in Reference 2 shows the impedance matching characteristic in a broad band. However, its size and weight are relatively large, and hence its utility is limited. Therefore, it is at present difficult to obtain an antenna apparatus that is relatively small in size and yet usable in a relatively wide frequency range.

SUMMARY OF THE INVENTION

It is an object of the present invention to provide a planar antenna apparatus capable of solving the above difficulty.

According to one aspect of the present invention, there is provided an antenna apparatus including a dielectric substrate, a planar antenna element disposed on the substrate, and a waveguide for propagating electromagnetic waves to or from the planar antenna element. The waveguide includes at least a first conductor and a second conductor extending along each other. Near a connection portion formed between the first and second conductors and the planar antenna element, there is provided a taper region in which a distance between mutually-facing edge portions of the first conductor and the second conductor increases approximately monotonously toward the planar antenna element.

The following more specific structures can be applied to the above construction of the antenna apparatus of the present invention. The first conductor comprises a center conductor, and a second conductor comprises at least one grounded conductor. The waveguide is disposed in the same plane as the planar antenna element, and is a co-planar waveguide that comprises a center conductor of the first conductor connected to the planar antenna element, and grounded conductors of the second conductor, each of which is formed at a distance from the center conductor on each side of the center conductor. The planar antenna element is a bow-tie antenna element having an isosceles triangular shape with a vertical angle of a desired value, or a teardrop-shaped antenna element whose shape is composed of a portion of an isosceles triangular shape with a vertical angle of a desired value and a portion of the circle inscribed in the isosceles triangle (the exact preferred shapes of the teardrop antenna element are described in detail below). The planar antenna apparatus is usable, for example, in a positional detecting system for detecting the position of an object on the basis of information of a delay time and a phase difference of electromagnetic wave pulses from the object to which electromagnetic pulses are applied from the planar antenna apparatus.

Further, the planar antenna element is an antenna element that is comprised of teardrop-shaped structures, each composed of a portion of an isosceles triangular shape with a vertical angle of a desired value and a portion of the circle inscribed in the isosceles triangle, arranged with their apexes facing each other. In this structure, the waveguide is preferably an unbalanced line that is converted into a balanced line via the taper region, and connected to the planar antenna element.

According to another aspect of the present invention, there is provided a planar antenna apparatus including a dielectric substrate, and a planar antenna element that is comprised of teardrop-shaped structures, each composed of a portion of an isosceles triangular shape with a vertical angle of a desired value and a portion of the circle inscribed in the isosceles triangle, arranged with their apexes facing each other. This planar antenna apparatus is a planar antenna apparatus whose band characteristic can be improved and which can be suitably made compact in size.

In connection with a planar antenna apparatus of the present invention with the above-discussed taper region, the antenna apparatus can be a planar type, and yet the matching between its antenna element and its waveguide can be achieved over a relatively wide frequency range.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

A description will hereinafter be given for embodiments of the present invention with reference to the drawings.

Figure 1:
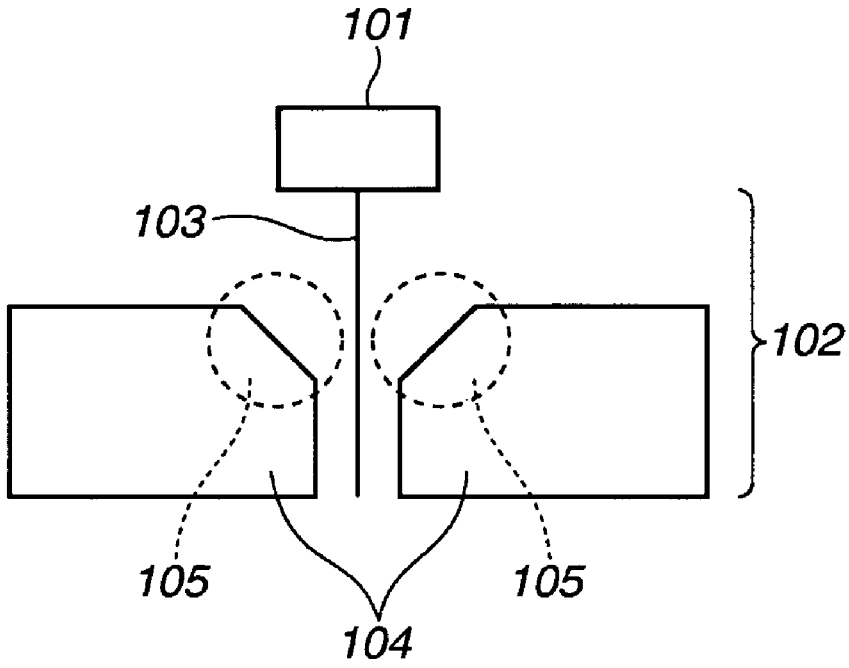
FIG. 1 is a plan view illustrating a first embodiment of a planar antenna apparatus according to the present invention.

FIG. 1 schematically illustrates the structure of a wideband planar antenna apparatus with an energy feed waveguide of a first embodiment of the present invention. As illustrated in FIG. 1, on a dielectric substrate (not shown in FIG. 1) of this type of planar antenna apparatus, there are formed an appropriately-shaped antenna element 101 for emitting a signal as electromagnetic waves, and a waveguide 102 for feeding the signal to the antenna element 101. In FIG. 1, the rectangular shape of the antenna element 101 does not indicate its actual shape, but only represents a location where the antenna element 101 is disposed. The embodiment illustrated in FIG. 1 uses, as the waveguide 102, a co-planar waveguide composed of a center conductor 103 and grounded conductors 104.

Figure 2:
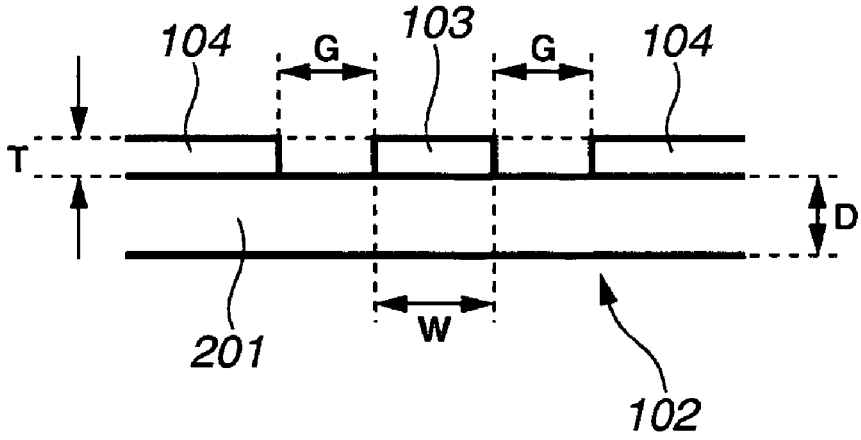
FIG. 2 is a cross-sectional view illustrating a waveguide of the first embodiment illustrated in FIG. 1.

FIG. 2 illustrates the cross-sectional structure of the co-planar waveguide. As illustrated in FIG. 2, the center conductor 103 with a width W and the grounded conductors 104 constituting the co-planar waveguide are formed on the same plane of a dielectric substrate 201 with a thickness D. The center conductor 103 is spaced from each grounded conductor 104 by a gap G. The center conductor 103 and the grounded conductors 104 are formed of metals with a thickness T, respectively. The characteristic impedance of the co-planar waveguide is determined from a distribution of electromagnetic fields generated between the center conductor 103 and the grounded conductors 104. For example, where the dielectric substrate 201 is formed of duroid 6010 LM (trade name) with a thickness D of 0.64 mm, a dielectric constant of 10.2, a dielectric loss tangent of 0.0023, and the thickness T of 0.035 mm (Cu), the characteristic impedance of the co-planar waveguide can be calculated to be 50 Ω when W=2.0 mm and G=0.6 mm.

Although the waveguide 102 is composed of the above co-planar waveguide with the characteristic impedance of 50 Ω in the first embodiment, the structure of the waveguide is not limited thereto. For example, it is possible to use a structure in which the center conductor 103 and grounded conductors 104 are formed on one surface of the dielectric substrate 201, and another grounded conductor is formed on the opposite surface of the dielectric substrate 104 (a co-planar waveguide with a ground plane). Characteristic impedances of the co-planar waveguide and the co-planar waveguide with a ground plane are different from each other because their electromagnetic-field distributions differ from each other.

In the wideband planar antenna apparatus with an energy feed waveguide of the first embodiment, a taper region 105 or an inclined edge portion is provided in a portion of each grounded conductor 104 of the waveguide 102. The taper region 105 serves to prevent the occurrence of undesired reflection of a signal propagating to the antenna element 101 through the waveguide 102 at a boundary portion between the waveguide 102 and the antenna element 101, where the electromagnetic-field distribution abruptly changes. The taper region 105 also serves to prevent the occurrence of undesired reflection of a signal propagating in the opposite direction.

In the first embodiment, the taper region 105 is inclined linearly, as illustrated in FIG. 1, but the configuration is not limited thereto. The taper region 105 can be inclined in a curved manner, a multi-linear manner, a multi-curved manner, or in a combination of these manners. In short, the taper region 105 near a connection portion formed between the waveguide 102 and the planar antenna element 101 only needs to be formed such that the distance between an edge portion of the grounded conductor 104 (a second conductor) and the center conductor 103 (a first conductor) increases approximately monotonically toward the planar antenna element 101.

The shape and position of the taper region 105 in the above-discussed embodiment are thus adjusted so that the impedance matching between the planar antenna element 101 and the waveguide 102 can be achieved over a broad frequency range. As a result, the reflection of a signal at the connection portion between the waveguide 102 and the planar antenna element 101 can be reduced, and the radiating characteristic and receiving characteristic of the planar antenna element 101 can be improved.

Accordingly, the efficiency of radiation of electromagnetic waves from the antenna apparatus can be increased, and a wideband transmission system can be driven with a lower consumption of power than can a conventional transmission system. Further, it is possible to provide a wideband planar antenna apparatus with an energy feed waveguide that is small in size and can carry frequencies throughout a broad band.

Furthermore, since the planar antenna element and the co-planar waveguide are present on the same plane, the first embodiment can be readily fabricated by simple printing techniques and miniaturization and mass-production thereof can be readily achieved. Moreover, its ability to be matched with another semiconductor device or another semiconductor circuit is superior, and it is easy to integrate with another device, because the co-planar waveguide is used for feeding power to the antenna element.

In general, the sensitivity of detecting a signal in a system is largely influenced by an S/N ratio of a detecting device provided in the system's initial stage. When the above-discussed antenna apparatus is used as a unit for detecting electromagnetic waves, there is no need to provide an additional through-hole and an additional waveguide, such as a line converting waveguide, and thus the number of signal propagation paths can be minimized. This is because the radiating characteristic of the antenna apparatus is improved by a simple structure, viz., the taper region, in a portion of the grounded conductor. Accordingly, loss of signals in the path can be reduced, and the S/N ratio can be increased, leading to establishment of a highly-sensitive wideband signal transmission system.

Figure 3:
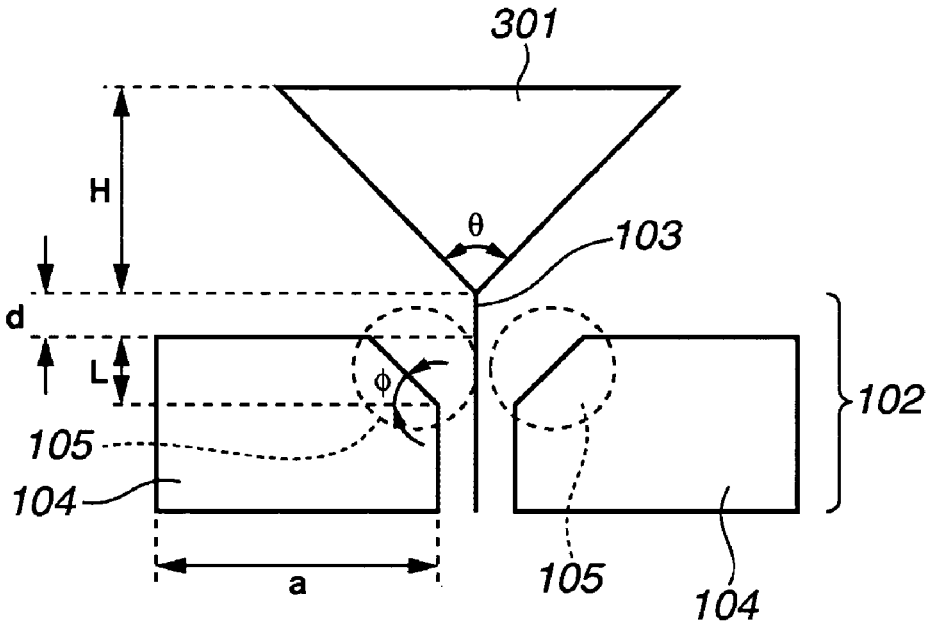
FIG. 3 is a plan view illustrating a second embodiment of a planar antenna apparatus according to the present invention.

FIG. 3 illustrates the structure of a wideband planar antenna apparatus with an energy feed waveguide of a second embodiment according to the present invention. The frequency characteristic of the second embodiment is calculated by using an electromagnetic-field simulator. The frequency band of the antenna apparatus is assumed to be approximately in a range from 3 GHz to 10 GHz in the second embodiment; however, the frequency band is not limited to that band, and any desired frequency band can be selected.

As illustrated in FIG. 3, the wideband planar antenna apparatus with an energy feed waveguide of the second embodiment uses a bow-tie antenna element 301 having an isosceles triangular shape with a vertical angle θ, and a waveguide 102 of a co-planar type having a taper region 105 formed in a portion of a grounded conductor 104. A dielectric substrate is formed of the above-stated duroid 6010 LM (trade name).

An approximate feature of frequency characteristic of the antenna element 301 can be known from its vertical angle θ, and its height H. The height H of the antenna element 301, chiefly, affects the minimum frequency (i.e., the lowest frequency of the frequency band of electromagnetic waves radiated from the antenna element) of the antenna element 301 (i.e., the frequency band of electromagnetic waves radiated from the antenna element). In the second embodiment, the height H is equal to 6.0 mm, and accordingly the minimum frequency is calculated to be about 4 GHz. The desired frequency band characteristic can be obtained by adjusting the antenna element height H.

The vertical angle θ of the antenna element 301, chiefly, affects the input impedance of the antenna element 301. In the second embodiment, the vertical angle θ is equal to 90 degrees, and accordingly the input impedance is calculated to be about 200 Ω.

As stated above, when the width D of the center conductor 103 is 2.0 mm and the gap G between the center conductor 103 and each grounded conductor 104 is 0.6 mm, the characteristic impedance of the waveguide 102 is calculated to be 50 Ω. Here, the width a of each grounded conductor 104 is set at 8.4 mm. In the second embodiment, the width a of the grounded conductor 104 is adjusted to be over 0.25 λ, where λ is the wavelength corresponding to the minimum frequency of the frequency characteristic of the antenna element 301. The width a of the grounded conductor 104 is, however, not limited thereto. It can be below 0.25 λ depending on the case (required specifications or the like).

In the second embodiment, the taper region 105 is defined by the distance d between the apex of the antenna element 301 and the end of the grounded conductor 104 constituting the waveguide 102, the length L of the taper region 105, and the taper angle ϕ of the taper region 105. In the second embodiment, the impedance matching between the antenna element 301 and the waveguide 102 is accomplished over a broad frequency range by adjusting those parameters. As stated above, the configuration of the taper region 105 is not limited to as is illustrated in FIG. 3.

The matching condition between the antenna element 301 and the waveguide 102 is evaluated by using a standing wave ratio (SWR). The SWR represents a ratio between the maximum value and the minimum value of the standing wave appearing due to interference between an incident wave (forward traveling wave) and a reflected wave. (rearward traveling wave). As the SWR comes close to one (1), the standing wave lessens, and signals fed to the antenna element 301 can be effectively emitted as electromagnetic waves, for example.

A description will be given for adjustment results of the taper region 105 in the following.

Figure 4:
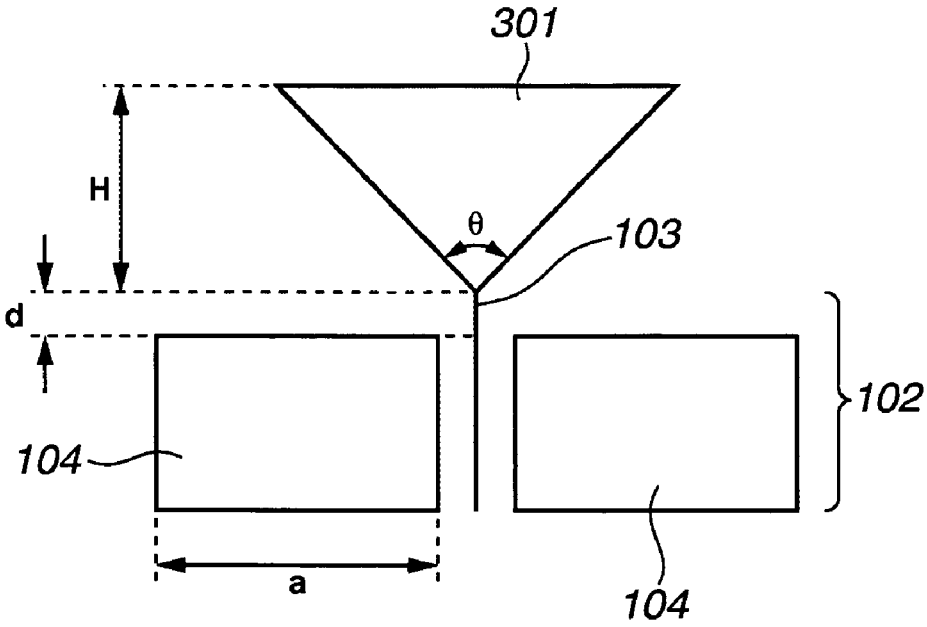
FIG. 4 is a plan view illustrating a comparative example of a planar antenna apparatus for demonstrating technical advantages of the second embodiment.

Comparison with a case without any taper region is carried out to show clearly the advantageous effects of the taper region 105. FIG. 4 illustrates a model without any taper region in the grounded conductor 104. In the structure of FIG. 4, to perform the impedance matching between the antenna element 301 and the waveguide 102, the distance d between the apex of the antenna element 301 and the end of the grounded conductor 104 constituting the waveguide 102 is adjusted. Here, as stated above, as the SWR comes close to one (1), the impedance matching between the antenna element 301 and the waveguide 102 is increased, and electromagnetic waves can be effectively emitted. In connection with the distance d, when the end of the grounded conductor 104 constituting the waveguide 102 goes toward the antenna element 301 beyond the apex of the antenna element 301, the sign of the distance d is taken as negative for convenience.

Figure 7:
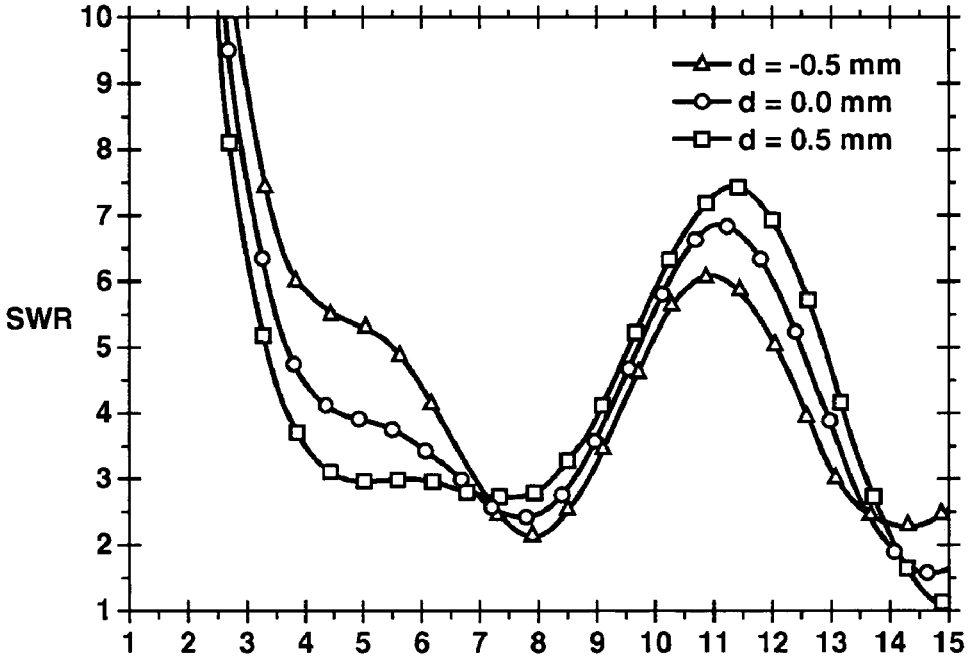
FIG. 7 is a graph showing the dependency of a relationship between frequency and SWR on a distance d between an antenna element and a ground in the second embodiment.

Results of analysis in the case without any taper region are shown in FIG. 7. It can be understood from FIG. 7 that frequency characteristic in this case changes sensitively with a change in the distance d. For example, when the distance d=−0.5 mm, though the frequency characteristic is somewhat depressed wholly, the radiating characteristic of the antenna apparatus shows a narrow band feature around 8 GHz. On the other hand, in the case of the distance d=0.5 mm, while the radiating characteristic of the antenna apparatus shows a relative uniformity around 6 GHz, the degradation rate on a high-frequency side (around 11 GHz) is relatively large.

Figure 8:
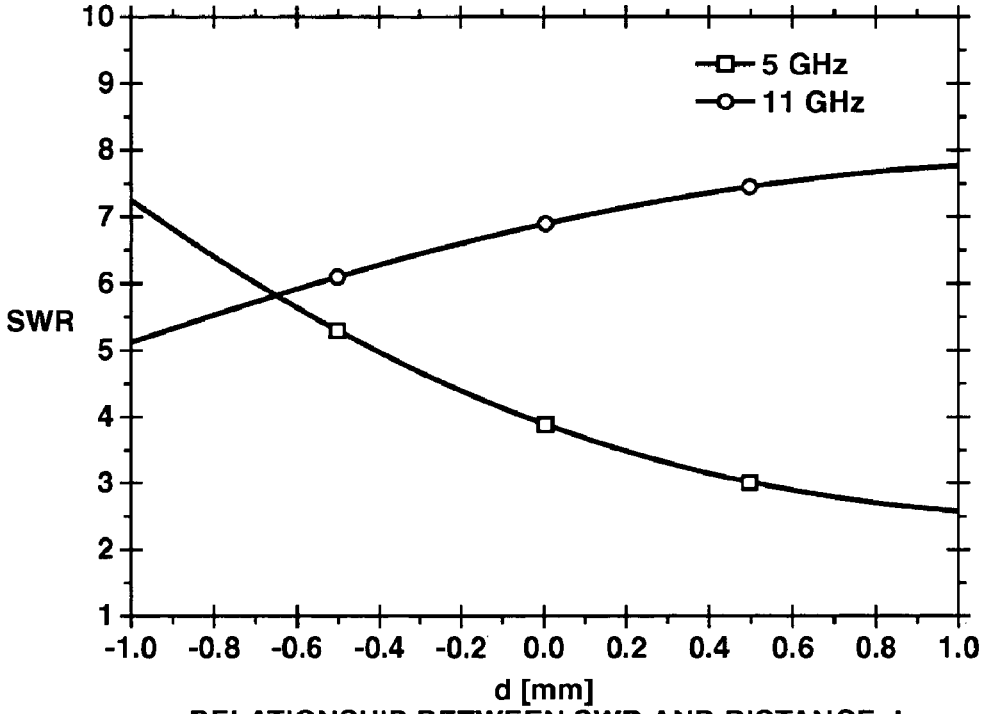
FIG. 8 is a graph showing the relationship between SWR and the distance d between the antenna element and the ground, which is obtained from the graph of FIG. 7.

FIG. 8 shows a graph produced by plotting values of SWR at desired feature points (5 GHz and 11 GHz) of the frequency characteristic illustrated in FIG. 7. As can be understood from FIG. 8, when the distanced is changed from −1.0 mm to 1.0 mm, the value of SWR at the feature point of 5 GHz on a low-frequency side is decreased or improved about 4.7 as the distance d is widened. However, the value of SWR at the feature point of 11 GHz on a high-frequency side is increased or degraded by about 2.7 as the distance d is widened. From the above, it can be said that the trade-off relationship among low-frequency side, high-frequency side, and bandwidth occurs when only the position of the end portion of the grounded conductor 104 is changed similarly to a conventional manner. Hence, impedance matching is difficult to achieve over a wide frequency range.

Accordingly, the taper region 105 is provided in a portion of the grounded conductor 104 of the conductor 102, as illustrated in FIG. 3. Advantageous effects of the taper region 105 will be described with reference to FIG. 9. Here, the distanced between the apex of the antenna element 301 and the end of the grounded conductor 104 is set at 0.5 mm whereat the radiating characteristic of the antenna apparatus shows a relatively uniform feature. Further, the taper angle ϕ is tentatively set at 45 degrees, and only the height L of the taper region 105 is changed.

Figure 9:
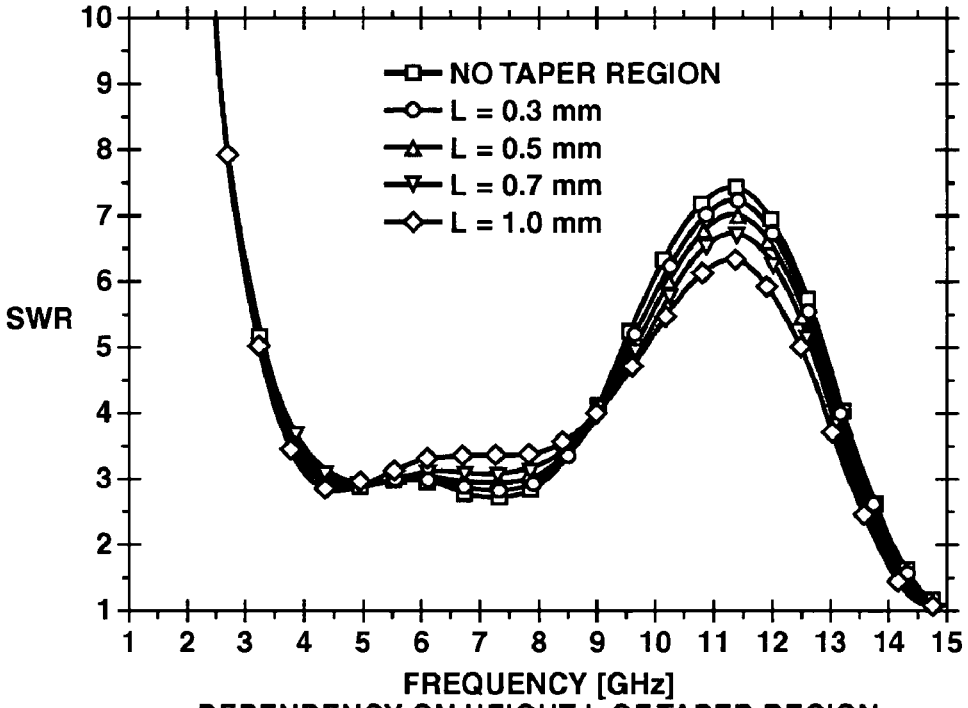
FIG. 9 is a graph showing the dependency of a relationship between frequency and SWR on a height L of a taper region in the second embodiment.
Figure 10:
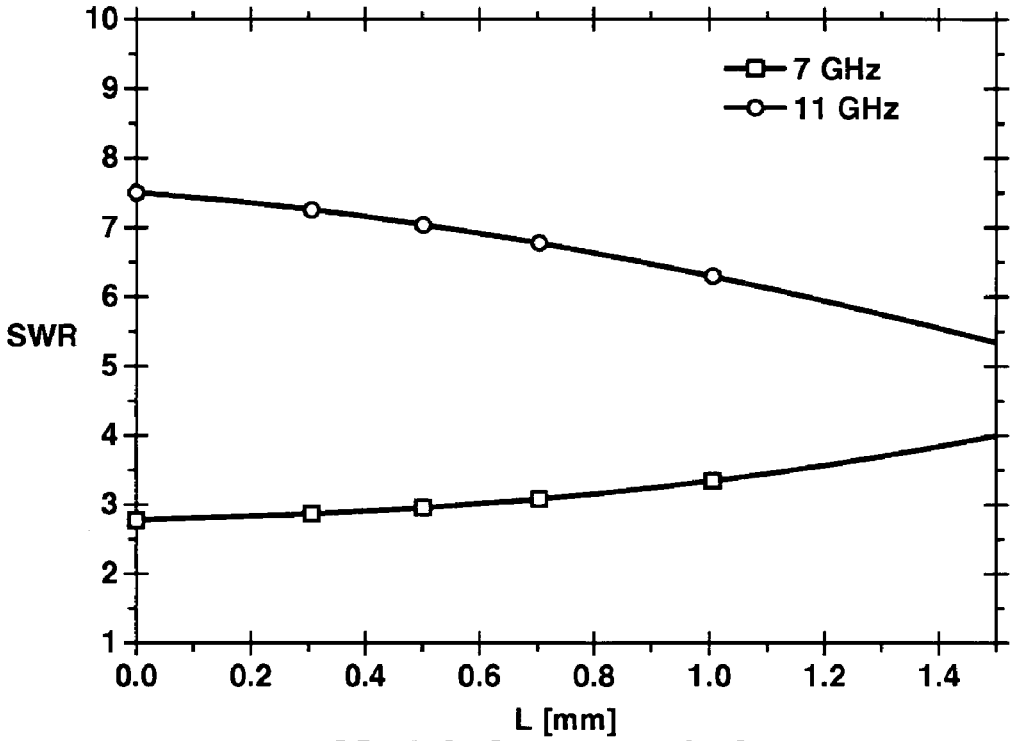
FIG. 10 is a graph showing the relationship between SWR and the height L of the taper region, which is obtained from the graph of FIG. 9.

It can be seen from FIG. 9 that when the height L of the taper region 105 is increased, the frequency characteristic on a high-frequency side around 11 GHz is relatively largely improved, though the frequency characteristic on a low-frequency side around 6 GHz is somewhat degraded. FIG. 10 shows a graph produced by plotting values of SWR at desired feature points (7 GHz/11 GHz) of the frequency characteristic illustrated in FIG. 9. It can be understood from FIG. 10 that when the height L of the taper region 105 is changed from 0.0 mm (i.e., corresponding to the model without any taper region as illustrated in FIG. 4) to 1.45 mm, the value of SWR at the feature point of 11 GHz on a high-frequency side is decreased or improved by about 3.1, though the value of SWR at the feature point of 7 GHz on a low-frequency side is increased or degraded by about 0.3. From the above, it can be known that when the taper region 105 is provided in the grounded conductor 104, the frequency characteristic on a high-frequency side can be improved without greatly lowering the frequency characteristic on a low-frequency side.

Figure 11:
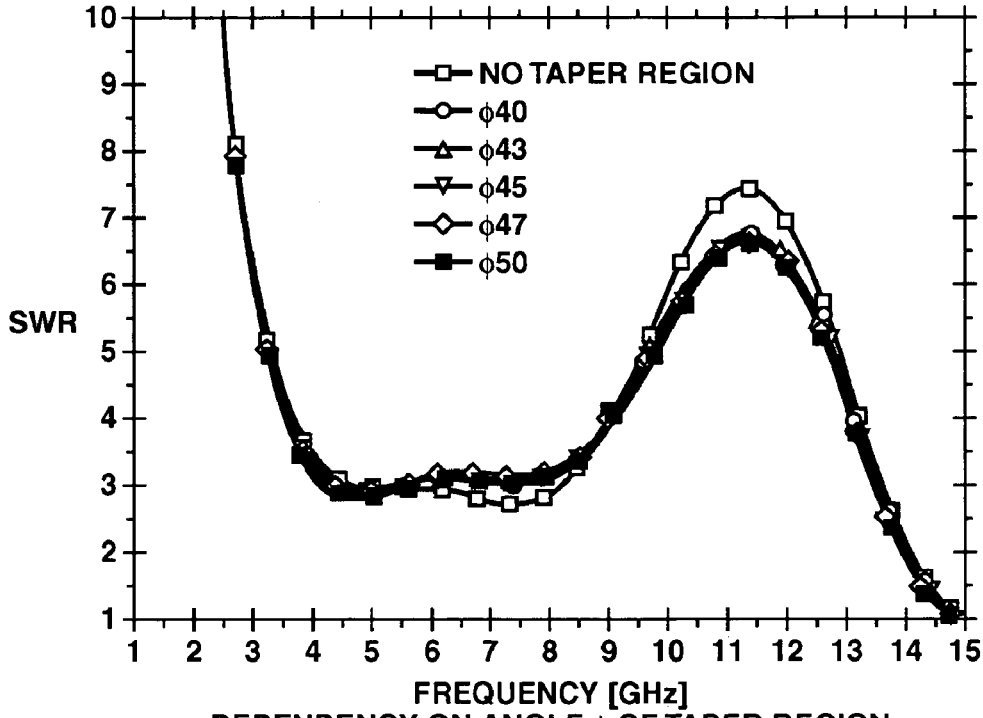
FIG. 11 is a graph showing the dependency of a relationship between frequency and SWR on an angle $\phi$ of the taper region in the second embodiment.

FIG. 11 shows effects obtained when the taper angle ϕ of the taper region 105 is changed. For comparison, also shown is a case where no taper region is provided, and the impedance matching between the antenna element 301 and the waveguide 102 is performed only by using the distance d between the apex of the antenna element 301 and the end of the grounded conductor 104 constituting the waveguide 102. The distance d is set at 0.5 mm, where the radiating characteristic of the antenna apparatus shows a relatively uniform feature. Further, the height or length L of the taper region 105 is set at 0.7 mm considering the above results.

Figure 12:
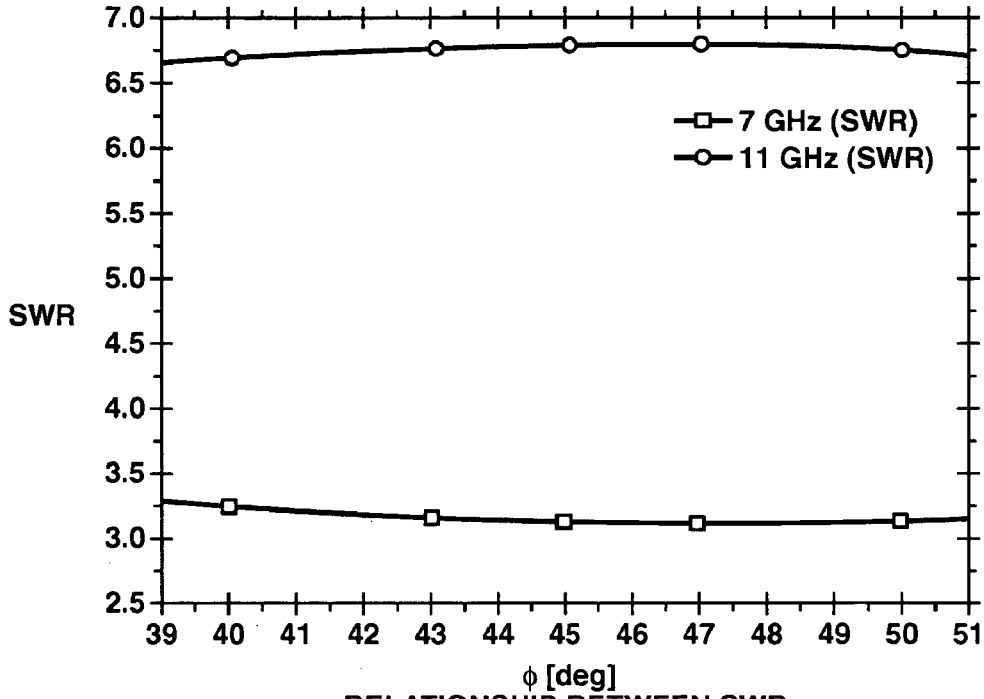
FIG. 12 is a graph showing the relationship between SWR and the angle $\phi$ of the taper region, which is obtained from the graph of FIG. 11.

According to FIG. 11, it seems that the frequency characteristic does not change so much even if the taper angle ϕ of the taper region 105 is changed. FIG. 12 shows a graph produced by plotting values of SWR at desired feature points (7 GHz/11 GHz) of the frequency characteristic illustrated in FIG. 11. As can be understood from FIG. 12, when the taper angle ϕ of the taper region 105 is changed from 39 degrees to 51 degrees, the value of SWR near the feature point of 7 GHz on a low-frequency side is decreased or improved about 0.2 while the value of SWR at the feature point of 11 GHz on a high-frequency side is increased or degraded about 0.2. At any rate, the radiating characteristic of the wideband planar antenna apparatus with an energy feed waveguide is not sensitive to a change in the taper angle ϕ of the taper region 105. Such insensitivity to the taper angle ϕ of the taper region 105, however, means that the radiating characteristic of the wideband planar antenna apparatus with an energy feed waveguide can be finely adjusted by controlling the taper angle ϕ of the taper region 105.

In the second embodiment, the input impedance of the antenna element 301 is approximately 200 Ω, and the characteristic impedance of the waveguide 102 is approximately 50 Ω. Accordingly, the impedance mismatching between the antenna element 301 and the waveguide 102 occurs, and the SWR is calculated to be relatively large. This problem, however, can be readily solved by replacing the characteristic impedance with what is equivalent to the input impedance of the antenna element 301.

As discussed above, it can be understood that when the taper region is provided in a portion of the grounded conductor of the waveguide constituting the wideband planar antenna apparatus with an energy feed waveguide, impedance matching can be achieved over a wider frequency range. Therefore, it can be predicted that the reflection of signals from the antenna element can be reduced over a wider frequency range, and the radiating characteristic of the antenna apparatus can be improved.

Further, when a positional detecting system is built using electromagnetic wave pulses from the above antenna apparatus, the radiating efficiency of the antenna apparatus can be improved over a wider frequency range. Accordingly, it is possible to improve the time resolution of the pulse, and precisely to detect a delay time and a phase difference. Thus, a positional detecting system with higher precision can be established.

Figure 5:
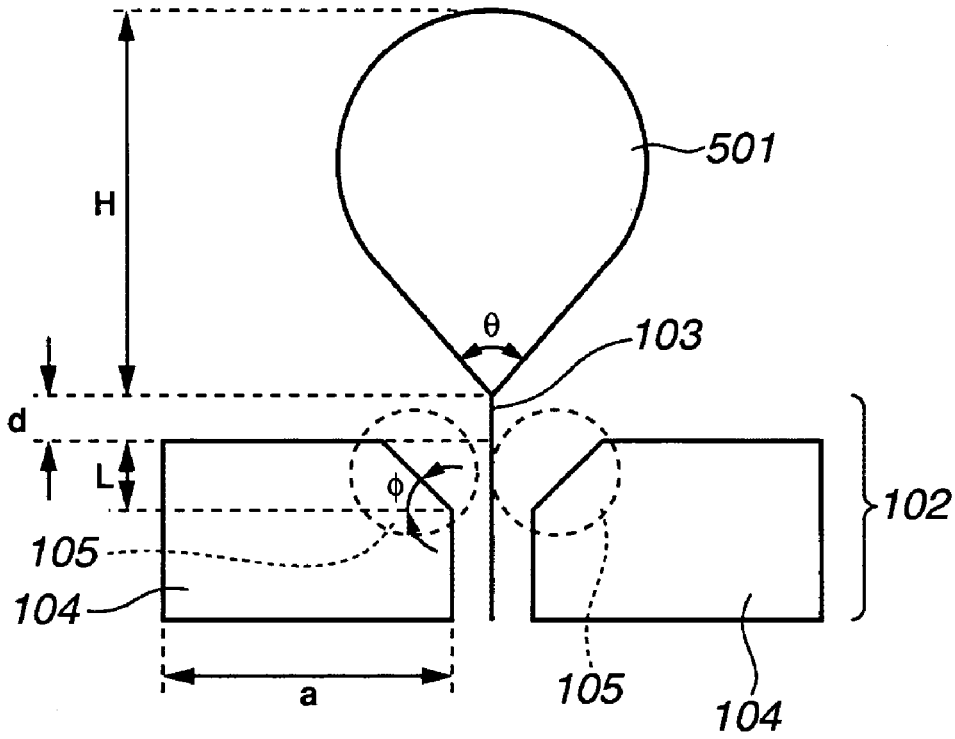
FIG. 5 is a plan view illustrating a third embodiment of a planar antenna apparatus according to the present invention.

FIG. 5 illustrates the structure of a wideband planar antenna apparatus with an energy feed waveguide according to a third embodiment of the present invention. The frequency characteristic of the wideband planar antenna apparatus with an energy feed waveguide of the third embodiment is also calculated by using an electromagnetic-field simulator. Further, also in the third embodiment, the frequency band of the antenna apparatus is assumed to be approximately in a range from 3 GHz to 10 GHz, but the frequency band is not limited thereto. Any desired frequency band can be selected.

Figure 5A:
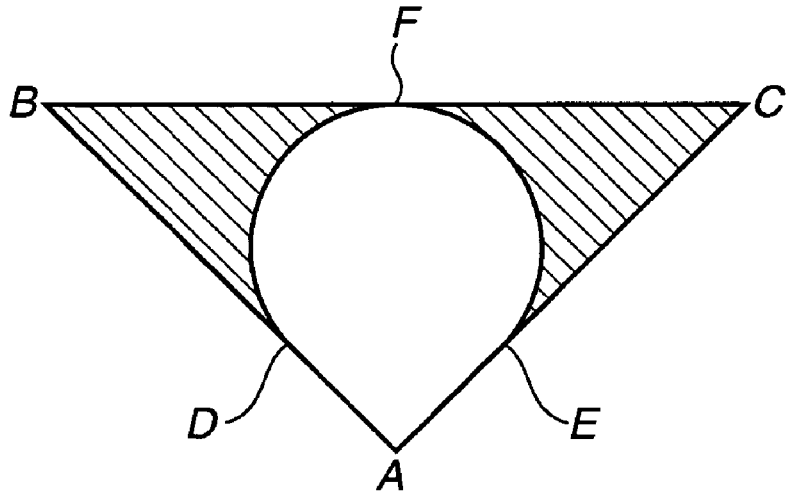
FIG. 5A is a diagram illustrating more precisely the preferred shape of the planar antenna of FIG. 5.

As illustrated in FIG. 5, the wideband planar antenna apparatus with an energy feed waveguide of the third embodiment uses a teardrop-shaped antenna element 501 whose shape is composed of an isosceles triangular shape with a vertical angle θ and an arc of a circle inscribed in the isosceles triangle, and a waveguide 102 of a co-planar type having a taper region 105 formed in a portion of each grounded conductor 104. As shown in FIG. 5A, the preferred shape of the teardrop-shaped antenna element 501 includes segments AD and AE, which are equal portions of equal sides AB and AC of isosceles triangle ABC, and arc DFE of the circle inscribed in that triangle. Also in the third embodiment, a dielectric substrate is formed of the above-stated duroid 6010 LM (trade name)

Also, in the third embodiment, an approximate feature of the frequency characteristic of the antenna element 501 can be known from its vertical angle θ, and its height H from the apex. The height H chiefly influences the minimum frequency of the frequency characteristic of the antenna element 501. In the third embodiment, the height H is equal to 25.0 mm, and accordingly the minimum frequency is calculated to be about 2.5 GHz. Desired frequency band characteristic can be achieved by adjusting the antenna height H.

The vertical angle θ of the antenna element 501 chiefly influences the input impedance of the antenna element 501. In the third embodiment, the vertical angle θ is equal to 90 degrees, and accordingly the input impedance of the antenna element 501 is calculated to be about 50 Ω.

As stated above, when the width W of the center conductor 103 is 2.0 mm and the gap G between the center conductor 103 and each grounded conductor 104 is 0.6 mm, the characteristic impedance of the waveguide 102 is calculated to be 50 Ω. Here, the width a of the grounded conductor 104 is set at 14.4 mm. Also in the third embodiment, the width a of each grounded conductor 104 is adjusted to be over 0.25λ where λ is the wavelength corresponding to the minimum frequency of the frequency characteristic of the antenna element 501. The width a of the grounded conductor 104 is, however, not limited thereto. It can be below 0.25λ depending on the case.

Also in the third embodiment, the taper region 105 is defined by the distance d between the apex of the antenna element 501 and the end of the grounded conductor 104 constituting the waveguide 102, the length L of the taper region 105, and the taper angle ϕ of the taper region 105, as illustrated in FIG. 5. Also in the third embodiment, the impedance matching between the antenna element 501 and the waveguide 102 is accomplished over a broad frequency range by adjusting those parameters. As stated above, the configuration of the taper region 105 is not limited to that illustrated in FIG. 5.

Similar to the second embodiment, the matching condition between the antenna element 501 and the waveguide 102 is evaluated by using the standing wave ratio (SWR) in the third embodiment.

A description will now be given for adjustment results of the taper region 105 in the following.

Figure 6:
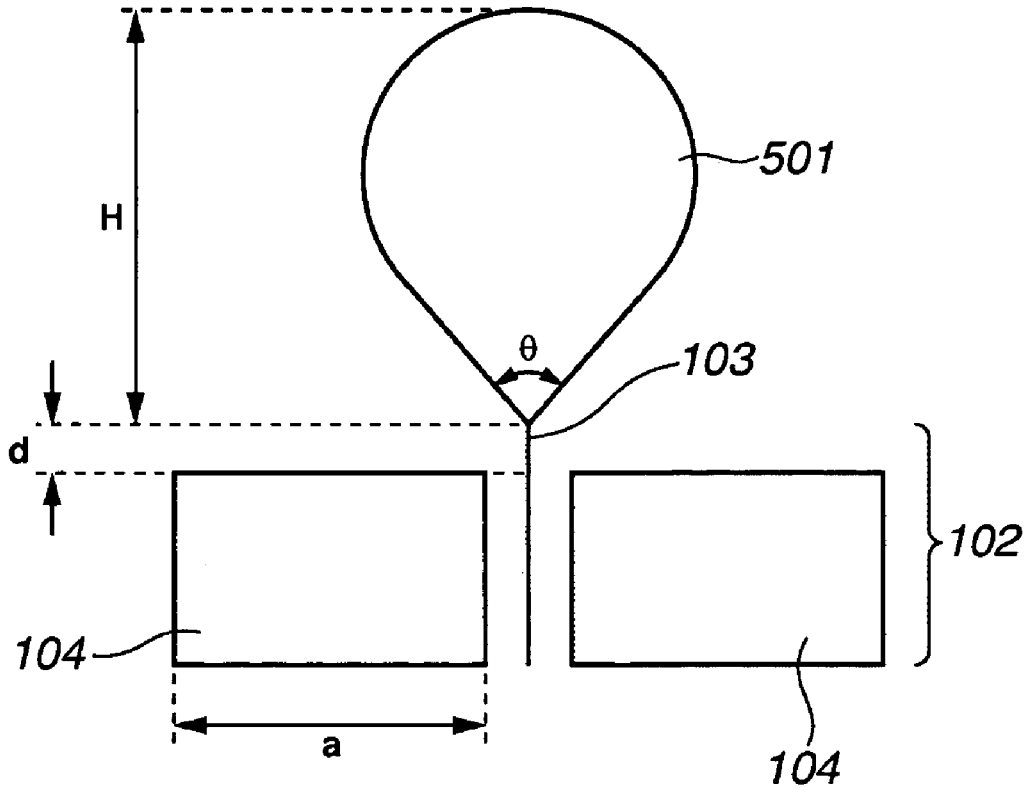
FIG. 6 is a plan view illustrating another comparative example of a planar antenna apparatus for demonstrating technical advantages of the third embodiment.

Comparison with a case without any taper region is carried out to demonstrate clearly the advantageous effects of the taper region 105. FIG. 6 illustrates a model without any taper region in the grounded conductor 104. In the structure of FIG. 6, to obtain impedance matching between the antenna element 501 and the waveguide 102, the distance d between the apex of the antenna element 501 and the end of the grounded conductor 104 constituting the waveguide 102 is adjusted. Here, as stated above, as the SWR comes close to one (1), the impedance matching between the antenna element 501 and the waveguide 102 is increased, and electromagnetic waves can be effectively emitted. In connection with the distance d, when the end of the grounded conductor 104 constituting the waveguide 102 goes toward the antenna element 301 beyond the apex of the antenna element 501, the distance d is taken as negative for convenience' sake.

Figure 13:
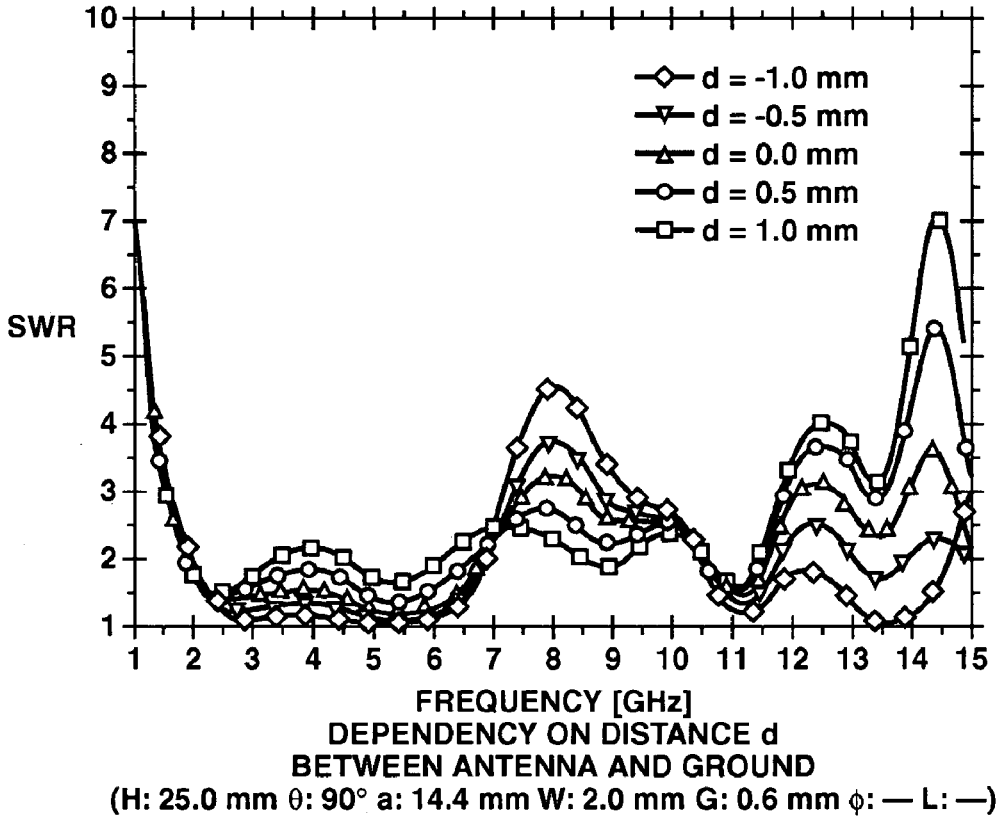
FIG. 13 is a graph showing the dependency of a relationship between frequency and SWR on a distance d between an antenna element and a ground in a third embodiment of the present invention.

Results of the analysis in the case without any taper region are shown in FIG. 13. It can be understood from FIG. 13 that the frequency characteristic in this case changes sensitively with a change in the distance d. As the distance d increases, values of the SWR in a range from about 3 GHz to about 6 GHz approach one (1) and flatten. However, the characteristic on a higher frequency side than 6 GHz is greatly degraded as the distance d increases.

Figure 14:
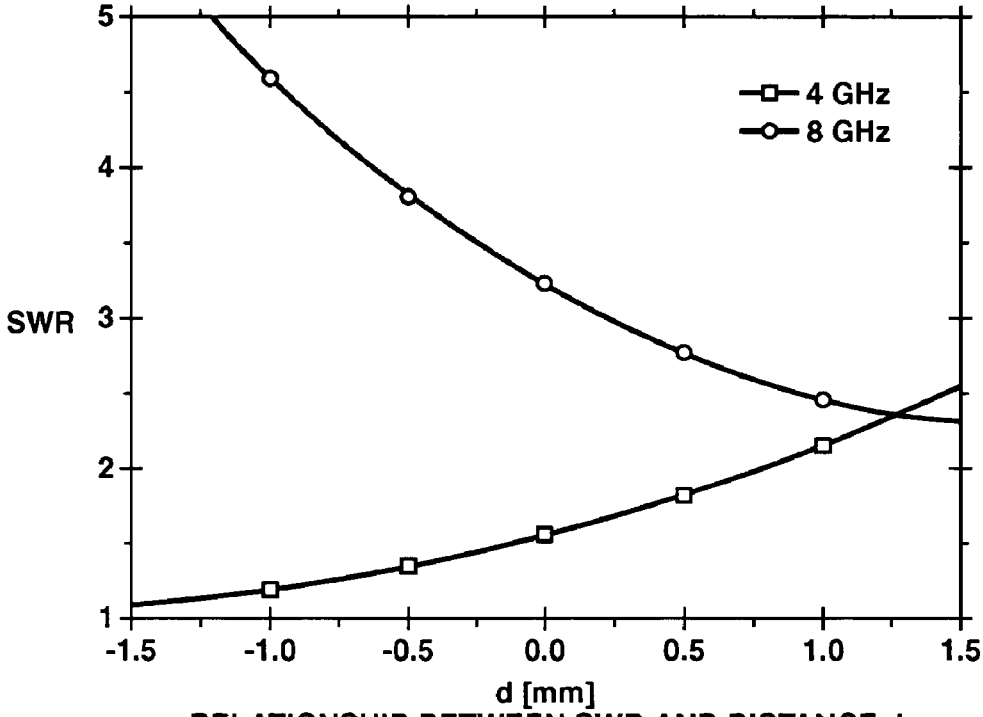
FIG. 14 is a graph showing the relationship between SWR and the distance d between the antenna element and the ground, which is obtained from the graph of FIG. 13.

FIG. 14 shows a graph produced by plotting values of SWR at desired feature points (4 GHz and 8 GHz) of the frequency characteristic illustrated in FIG. 13. As can be understood from FIG. 14, when the distance d is changed from −1.5 mm to 1.5 mm, the value of SWR at the feature point of 4 GHz on a low-frequency side is decreased or improved about 2.0. However, the value of SWR at the feature point of 8 GHz on a high-frequency side is increased or degraded by about 3.7. From the above, it can be said that when only the position of the end portion of the grounded conductor 104 is changed, similarly to a conventional manner, impedance matching is difficult to achieve over a wide frequency range due to the trade-off relationship between the frequency band characteristic of the wideband antenna apparatus with an energy feed waveguide and the radiating efficiency of the antenna apparatus, even though the radiating efficiency of the antenna apparatus is locally improved.

Accordingly, as illustrated in FIG. 5, the taper region 105 is provided in a portion of the grounded conductor 104 of the waveguide 102 illustrated in FIG. 6. Advantageous effects of the taper region 105 will be described with reference to FIG. 15. Here, the distance d between the apex of the antenna element 501 and the end of the grounded conductor 104 is set at 0.5 mm whereat the radiating characteristic of the antenna apparatus shows a relatively uniform feature. Further, the taper angle ϕ is tentatively set at 45 degrees, and only the length L of the taper region 105 is changed.

Figure 15:
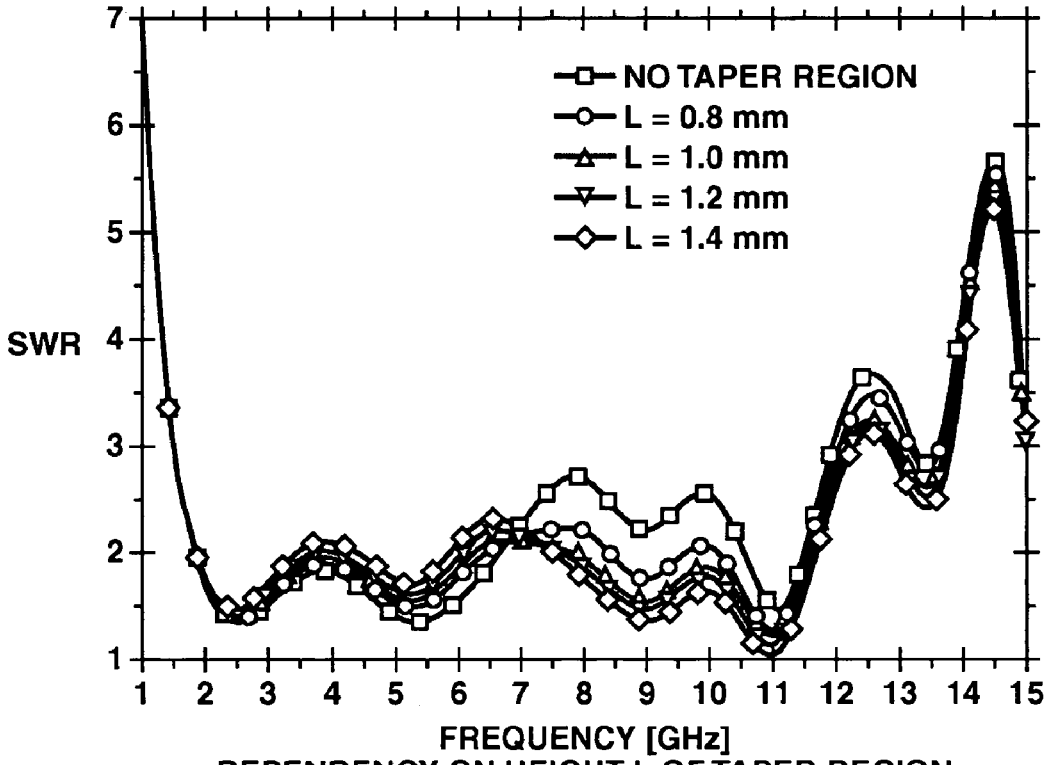
FIG. 15 is a graph showing the dependency of a relationship between frequency and SWR on a height L of a taper region in the third embodiment.
Figure 16:
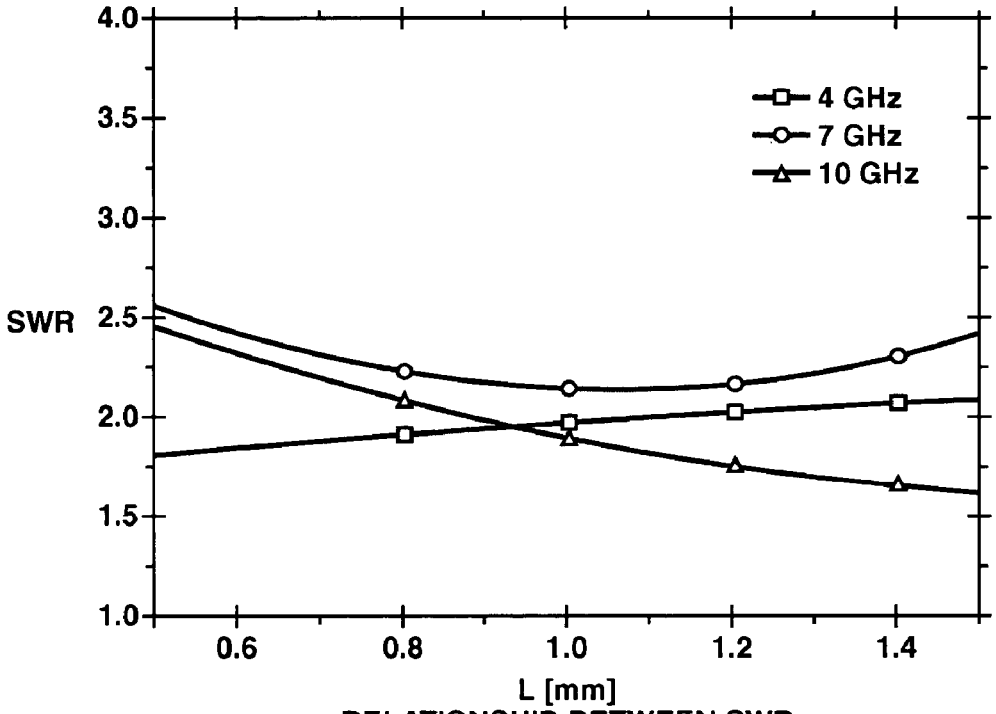
FIG. 16 is a graph showing the relationship between SWR and the height L of the taper region, which is obtained from the graph of FIG. 15.

It can be seen from FIG. 15 that when the taper region 105 is formed, values of SWR in a range from about 6 GHz to about 11 GHz are greatly improved. FIG. 16 shows a graph produced by plotting values of SWR at desired feature points (4 GHz/7 GHz/10 GHz) of the frequency characteristic illustrated in FIG. 15. It can be understood from FIG. 16 that when the length L of the taper region 105 is changed from 0.55 mm to 1.45 mm, the value of SWR near the point of 4 GHz is increased or degraded about 0.6, and the value of SWR near the point of 7 GHz reaches a minimum near a point where the length L is 1.0 mm. Further, the value of SWR near the point of 10 GHz is decreased or improved about 1.1. From the above, it can be seen that when the taper region 105 is provided in the grounded conductor 104, the frequency characteristic on a high-frequency side can be improved without greatly lowering the frequency characteristic on a low-frequency side.

Figure 17:
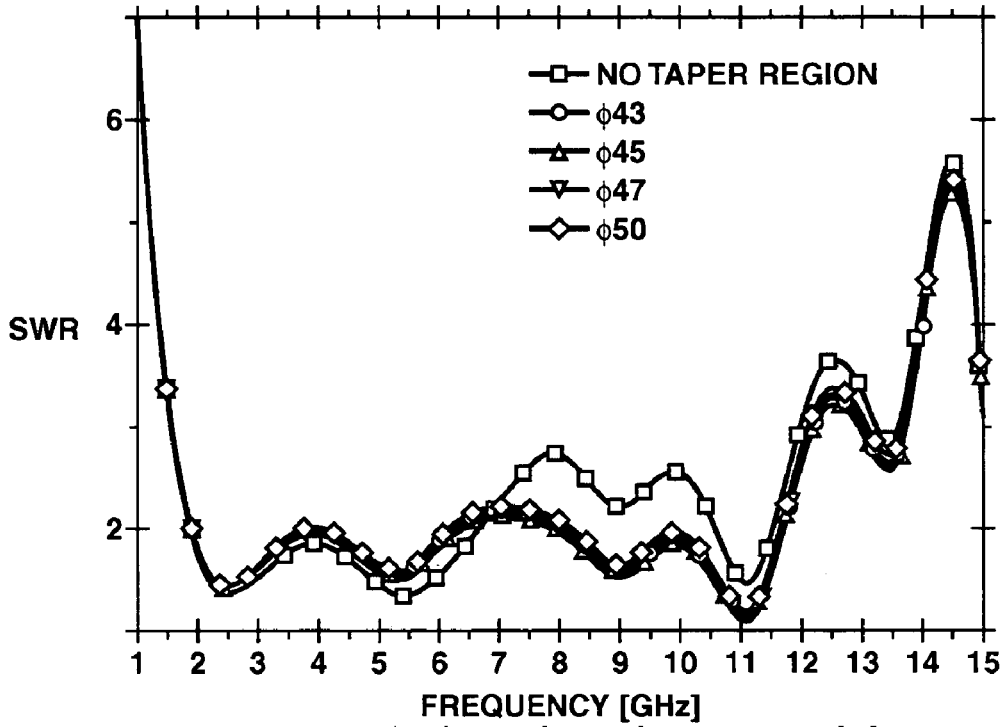
FIG. 17 is a graph showing the dependency of a relationship between frequency and SWR on an angle $\phi$ of the taper region in the third embodiment.

FIG. 17 shows effects obtained when the taper angle ϕ of the taper region 105 is changed. For comparison, also shown is a case where no taper region is provided, and the impedance matching between the antenna element 501 and the waveguide 102 is performed only by using the distance d between the apex of the antenna element 501 and the end of the grounded conductor 104 constituting the waveguide 102. The distance d is set at 0.5 mm, where the radiating characteristic of the antenna apparatus shows a relative uniformity. Further, the length L of the taper region 105 is set at 1.0 mm considering the above results.

Figure 18:
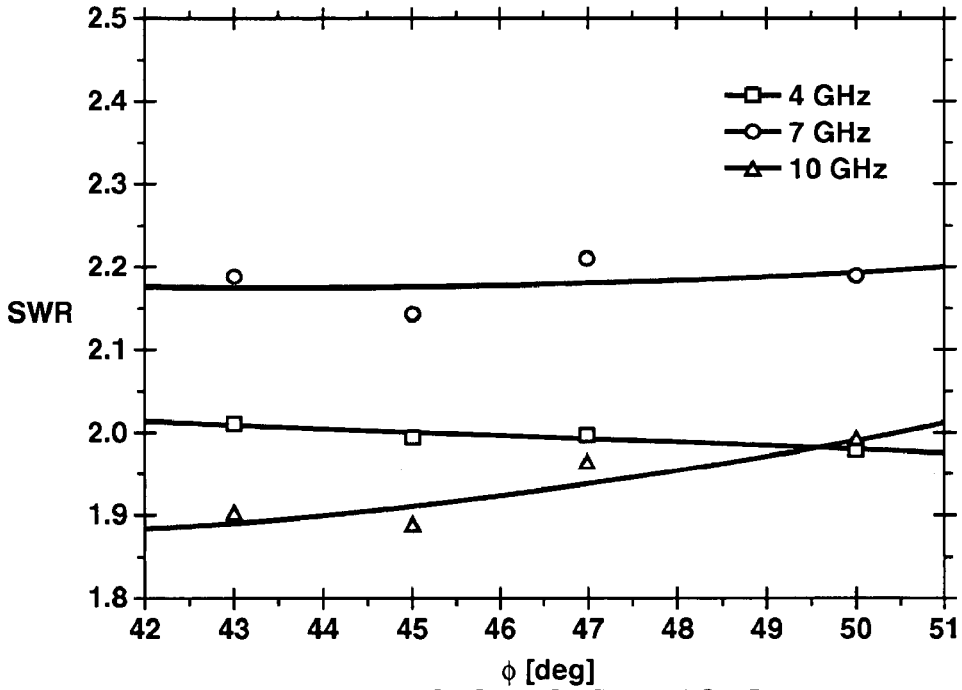
FIG. 18 is a graph showing the relationship between SWR and the angle $\phi$ of the taper region, which is obtained from the graph of FIG. 17.

According to FIG. 17, it seems that the frequency characteristic does not change so much even if the taper angle ϕ of the taper region 105 is changed. FIG. 18 shows a graph produced by plotting values of SWR at desired feature points (4 GHz/7 GHz/10 GHz) of the frequency characteristic illustrated in FIG. 17. As can be understood from FIG. 18, when the taper angle ϕ of the taper region 105 is changed from 42 degrees to 51 degrees, the value of SWR near the point of 4 GHz is decreased or improved about 0.05, while the value of SWR near the point of 7 GHz is increased or degraded about 0.03 and the value of SWR near the point of 10 GHz is increased or degraded about 0.14. At any rate, the radiating characteristic of the wideband planar antenna apparatus with an energy feed waveguide is not sensitive to a change in the taper angle ϕ of the taper region 105. However, also here, the insensitivity to the taper angle ϕ means that the radiating characteristic of the wideband planar antenna apparatus with an energy feed waveguide can be finely adjusted by controlling the taper angle ϕ.

Also in the above-discussed third embodiment, advantageous effects similar to those of the second embodiment can be obtained.

A description will now be given of a fourth embodiment directed to an antenna apparatus with a planar antenna element having a couple of teardrop-shaped structures (a dual teardrop planar antenna element). In such an antenna apparatus, it is difficult to connect an unbalanced waveguide, which has a superior matching property with another semiconductor device or another semiconductor circuit, directly to the dual teardrop planar antenna element.

Figure 19:
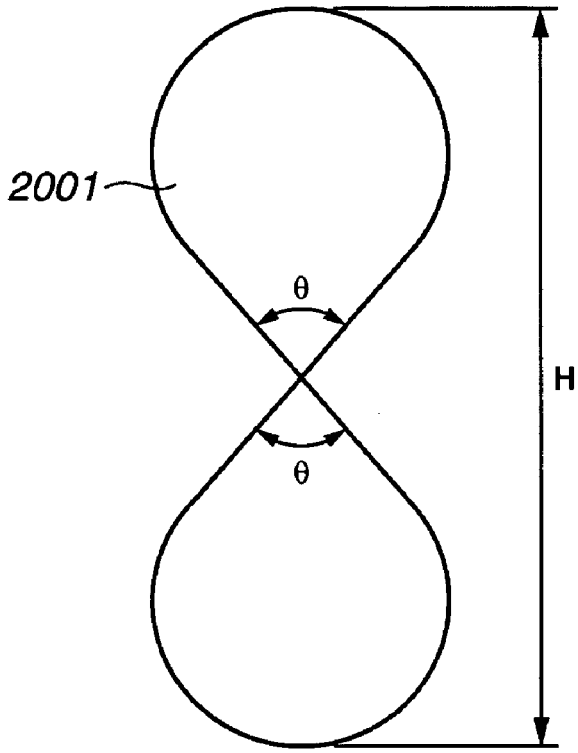
FIG. 19 is a plan view illustrating a model of a planar antenna element used in a fourth embodiment of the present invention.

FIG. 19 illustrates a dual teardrop planar antenna element 2001 used in the wideband planar antenna apparatus with an energy feed waveguide of the fourth embodiment. In the fourth embodiment, the planar antenna apparatus with an energy feed waveguide is designed by using an electromagnetic-field simulator. The frequency characteristic of the fabricated planar antenna apparatus with an energy feed waveguide is measured using a network analyzer.

Also in the fourth embodiment, the frequency band of the antenna apparatus is assumed to be approximately in a range from 3 GHz to 10 GHz. However, the frequency band is not limited thereto, and any desired frequency band can be selected. The antenna apparatus of the fourth embodiment can be used as an antenna apparatus for a terahertz-wave range (i.e., from 30 GHz to 30 THz), for example.

The planar antenna element in the fourth embodiment is a dual teardrop antenna element which is comprised of structures composed of an isosceles triangular shape with a vertical angle θ and a circle inscribed to a base of the isosceles triangle. These structures are disposed on a dielectric substrate facing each other at their apexes with a narrow gap (this is an an energy feed portion) therebetween (also see FIG. 25). It is difficult for an unbalanced waveguide, such as the above-described co-planar waveguide, differentially to operate such a dual teardrop antenna element in which two antenna element structures are arranged facing each other about an energy feed portion. Accordingly, it is preferable to use a balanced waveguide, such as a co-planar strip line.

Figure 20:
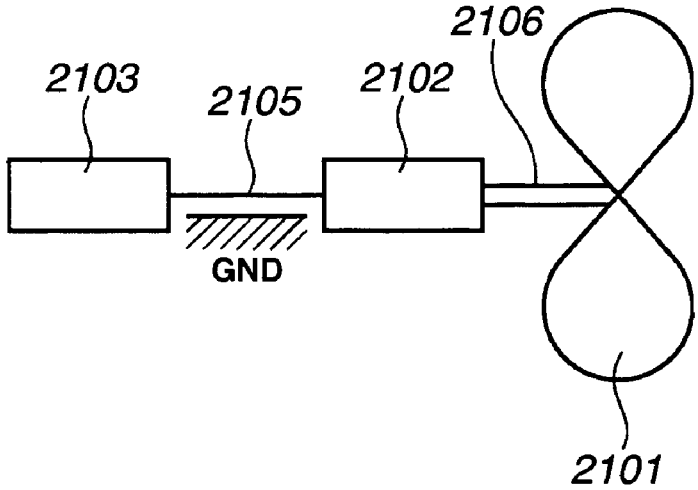
FIG. 20 is a plan view illustrating a wideband planar antenna apparatus with an energy feed waveguide of the fourth embodiment.

In the fourth embodiment, as illustrated in FIG. 20, a line converting portion 2102 is employed to achieve the impedance matching between an antenna element 2101 and a high-frequency circuit 2103, and convert the line shape of an energy feed waveguide from an unbalanced configuration 2105 to a balanced configuration 2106.

Figure 21:
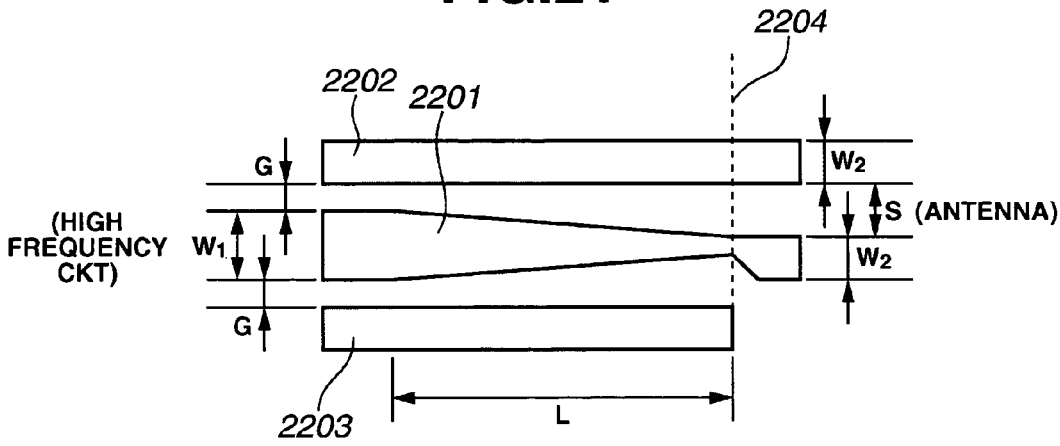
FIG. 21 is a plan view illustrating a structural example of a feed line converting portion illustrated in FIG. 20.

FIG. 21 illustrates a structure of the line converting portion 2102. As illustrated in FIG. 21, to convert the co-planar waveguide of the unbalanced waveguide into the co-planar strip line of the balanced waveguide, the co-planar strip line is comprised of a first conductor (a center conductor) 2201 constituting the co-planar waveguide, and a second conductor 2202 constituting a portion of the grounded conductor. With the co-planar waveguide, the characteristic impedance of the line is determined from the width W1 of the first conductor (the center conductor) 2201, and the gap G between the first conductor (the center conductor) 2201 and each grounded conductor (the second conductor 2202, and the third conductor 2203). In contrast, the characteristic impedance of the co-planar strip line is determined from the width W2 of two conductors (the first conductor 2201, and the second conductor 2202), and the distance S therebetween.

For example, when the dielectric substrate is formed of duroid 5880 (trade name) with a thickness D of 0.787 mm, a dielectric constant of 2.2, and a dielectric loss tangent of 0.0009 and the grounded conductor is formed of copper (Cu) with a thickness T of 0.035 mm, the characteristic impedance of the co-planar waveguide is calculated to be about 50 Ω and the characteristic impedance of the co-planar strip line is calculated to be 180 Ω, where W1 is 2.6 mm, G is 0.2 mm, W2 is 1.0 mm, and S is 1.3 mm. In the structure illustrated in FIG. 21, apex end portions of the teardrop-shaped structures in the antenna element 2101 are connected to the first conductor 2201 and the second conductor 2202, respectively.

In the fourth embodiment, since the high-frequency circuit 2103 is assumed to be a circuit of 50 Ω, parameters of the co-planar waveguide are determined such that its characteristic impedance can be 50 Ω. Parameters, however, are not limited thereto. Parameters vary depending on the characteristic impedance of the high-frequency circuit 2103. Also with the co-planar strip line, parameters vary depending on the antenna resistance of the antenna element 2101 used. This holds true in all the embodiments.

Here, if the co-planar waveguide with the characteristic impedance of 50 Ω is connected to the co-planar strip line with the characteristic impedance of 180 Ω, the impedance mismatching appears at a connection portion 2204, leading to degradation of the propagation characteristic of electromagnetic waves. Therefore, in the fourth embodiment, there is provided a taper region in a portion of the co-planar waveguide, wherein distances between the first conductor (the center conductor) 2201 and the second and third conductors (the grounded conductors) 2202 and 2203 are gradually increased toward the antenna element, as illustrated in FIG. 21.

In such a taper region, the width W of the first conductor (the center conductor) 2201 is decreased and gaps G between the first conductor (the center conductor) 2201 and the second and third conductors 2202 and 2203 are increased toward the antenna element, so that the characteristic impedance increases. Thus, the taper configuration in the fourth embodiment can have an impedance converting function. More specifically, when the taper configuration is adjusted such that the characteristic impedance of the co-planar waveguide can be matched with the characteristic impedance of the co-planar strip line, the impedance mismatching at the connection portion 2204 is mitigated, leading to improvement of the propagation characteristic of electromagnetic waves.

In the fourth embodiment, with parameters of the co-planar waveguide at the connection portion 2204, W1 is set at 0.4 mm, G is set at 1.3 mm, and the characteristic impedance is calculated to be approximately 180 Ω. Further, the length L of the taper region is set at about 0.25λ where λ is the wavelength corresponding to the minimum frequency of the bandwidth characteristic of the antenna apparatus. In this embodiment, the length L of the taper region is 40 mm.

In the taper configuration of the line converting portion 2101 in the fourth embodiment, a change in the distance between the first conductor 2201 and the second conductor 2202 is symmetrical with a change in the distance between the first conductor 2201 and the third conductor 2203. The taper configuration, however, is not limited thereto. For example, a change in the distance between a first conductor 2301 and a second conductor 2302 can be asymmetrical with respect to a change in the distance between the first conductor 2301 and a third conductor 2303, as illustrated in FIG. 22.

Figure 22:
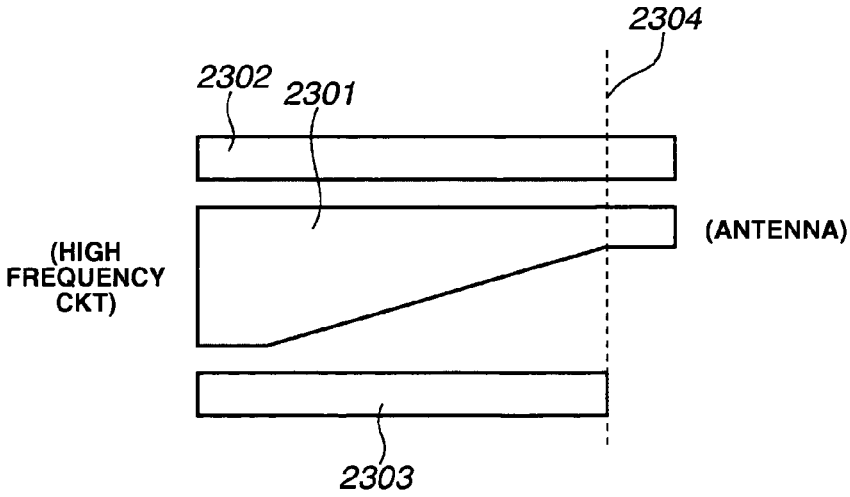
FIG. 22 is a plan view illustrating another structural example of the feed line converting portion illustrated in FIG. 20.

Also in the structure illustrated in FIG. 22, apex end portions of the teardrop-shaped structures in the antenna element 2101 are connected to the first conductor 2301 and the second conductor 2302 at a connection portion 2304, respectively. However, as with the above embodiments, structures of the waveguide and the line are not limited to those specifically discussed.

Figure 23:
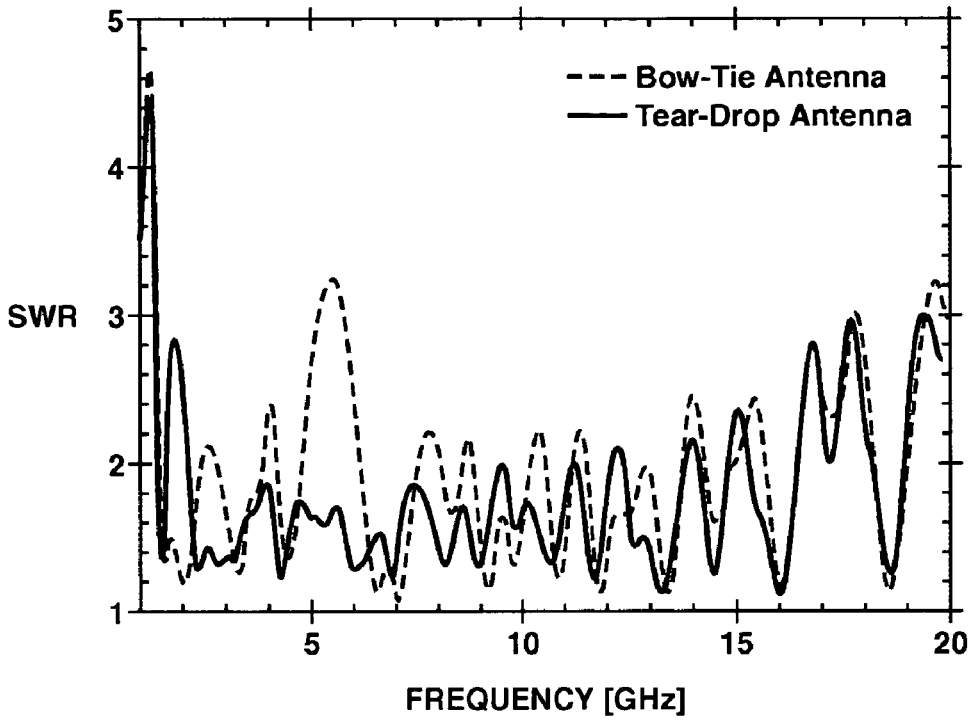
FIG. 23 is a graph showing relationships between frequency and SWR of two types (a bow-tie antenna apparatus and a teardrop antenna apparatus).
Figure 24:
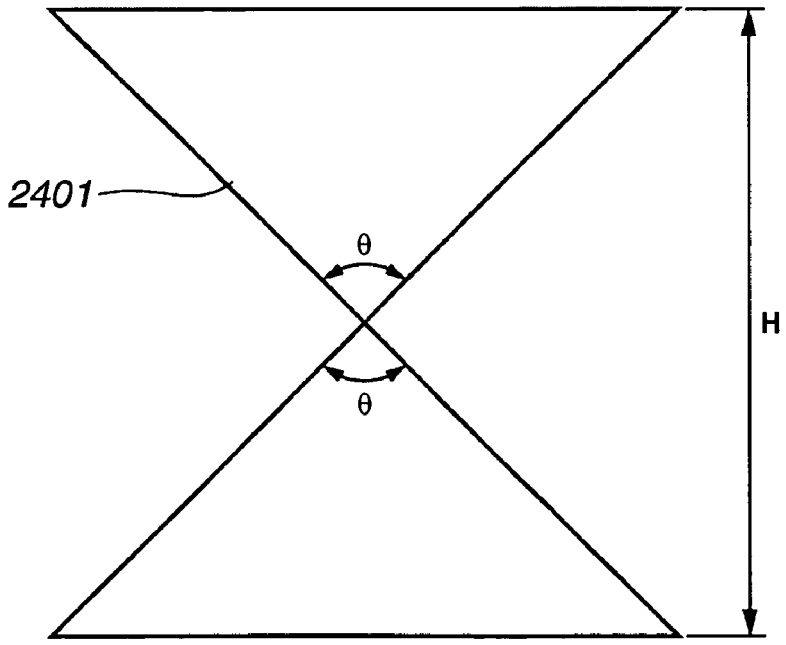
FIG. 24 is a plan view illustrating a model of a planar antenna element used for showing technical advantages of the fourth embodiment.

FIG. 23 shows measurement results (SWR) obtained in the fourth embodiment. For comparison, also shown are measurement results (indicated by dotted line) obtained in a case where power is fed to an antenna element 2401 illustrated in FIG. 24 using the line converting portion 2102. The antenna element 2401 illustrated in FIG. 24 is a self-similar type antenna called a bow-tie antenna, which is capable of showing a wideband frequency characteristic. With antenna elements as illustrated in FIGS. 19 and 24, the minimum frequency of the band characteristic is defined by the height H of the antenna element, and the input impedance of the antenna element is defined by the center angle θ of the antenna element. As a result of analysis, when H is 80 mm and θ is 90 degrees, the minimum frequency of each antenna element is about 2 GHz, and the input impedance of each antenna element is calculated to be about 180 Ω.

When those measurement results are compared with each other, it can be understood that the SWR characteristic of the antenna configuration (the dual teardrop antenna element as illustrated in FIG. 19) in the fourth embodiment is apparently improved more than that of a conventional wideband antenna element, such as the antenna element as illustrated in FIG. 24. In other words, it can be understood that the radiating efficiency of the dual teardrop antenna element as illustrated in FIG. 19 is improved more than that of the conventional wideband antenna element.

Figure 25:
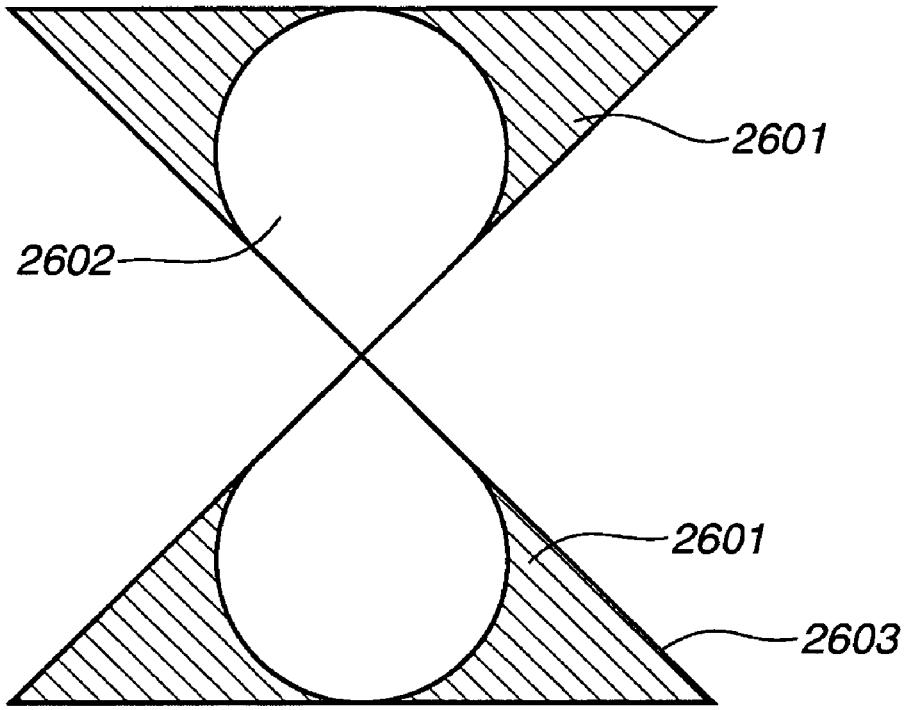
FIG. 25 is a plan view comparatively illustrating two models of the planar antenna element.
Figure 26:
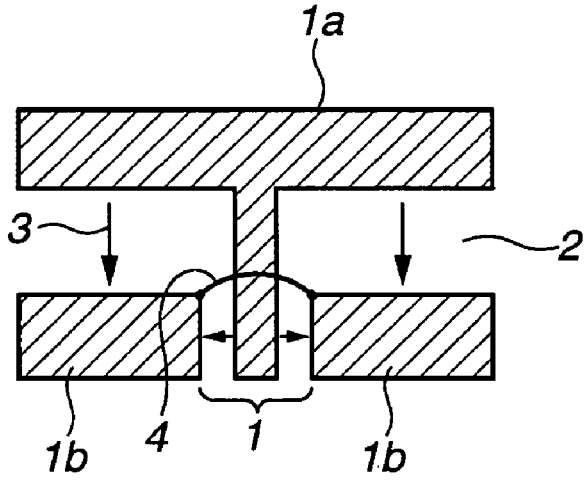
FIG.26 (PRIOR ART)
FIG. 26 is a plan view illustrating a conventional antenna apparatus.

FIG. 25 shows the occupation area of a dual teardrop antenna element 2602 used in the fourth embodiment, compared with the occupation area of a bow-tie antenna element 2603. The occupation area of the dual teardrop antenna element used in the fourth embodiment is smaller than that of the bow-tie antenna element with the same height H by the area of eliminated regions 2601 indicated by hatching. Since the vertical angle θ of each of facing isosceles triangles is 90 degrees in the fourth embodiment, the occupation area of the antenna element can be reduced by 42%, and the band characteristic of the antenna element can be improved. In short, when the antenna element of the fourth embodiment is used, the size of a circuit device including the antenna element can be readily decreased since a preferable band frequency of the antenna apparatus can be maintained even if the occupation area of the antenna element is reduced.

Further, also in the fourth embodiment, when a positional detecting system is built using electromagnetic wave pulses from the above-discussed antenna apparatus, the radiating efficiency of the antenna apparatus can be improved over a wider frequency range. Accordingly, it is possible to improve the time resolution of the pulse, and precisely detect a delay time and a phase difference. Thus, a positional detecting system with higher precision can be established.

As many apparently widely different embodiments of the present invention can be made without departing from the spirit and scope thereof, it is to be understood that the invention is not limited to the specific embodiments thereof except as defined in the claims.

This application claims priority to Japanese Patent Applications No. 2004-272676, filed Sep. 21, 2004, and No. 2005-77213, filed Mar. 17, 2005, the contents of which are hereby incorporated by reference.

What is claimed is:

1. An antenna apparatus comprising:

a dielectric substrate;

a planar antenna element disposed on the substrate; and a waveguide for propagating electromagnetic waves to or from the planar antenna element, wherein the waveguide comprises at least a first conductor and a second conductor extending along each other, and near a connection portion formed between the first and second conductors and the planar antenna element, there is provided a taper region in which a distance between mutually-facing edge portions of the first conductor and the second conductor increases approximately monotonically toward the planar antenna element.

2. An antenna apparatus according to claim 1, wherein the first conductor comprises a conductor comprises a center conductor, and the second conductor comprises at least a grounded conductor.

3. An antenna apparatus according to claim 2, wherein the waveguide is disposed in the same plane as the planar antenna element, and comprises a co-planar waveguide having a center conductor of the first conductor connected to the planar antenna element, and grounded conductors of the second conductor, each of which is formed at a distance from the center conductor on each side of the center conductor.

4. An antenna apparatus according to claim 1, wherein the planar antenna element is a bow-tie antenna element having an isosceles triangular shape with a vertical angle of a desired value.

5. An antenna apparatus according to claim 1, wherein the planar antenna element is a teardrop-shaped antenna element whose shape is composed of a portion of an isosceles triangular shape with a vertical angle of a desired value and an arc of a circle inscribed in the isosceles triangle.

6. An antenna apparatus according to claim 1, wherein the planar antenna element is comprised of teardrop-shaped structures, each composed of a portion of an isosceles triangular shape with a vertical angle of a desired value and an arc of a circle inscribed in the isosceles triangle, arranged with their apexes facing each other.

7. An antenna apparatus according to claim 6, wherein the waveguide is an unbalanced line which is converted into a balanced line via the taper region, and connected to the planar antenna element.

8. An antenna apparatus comprising:

a dielectric substrate; and a planar antenna element disposed on the substrate, wherein the planar antenna element comprises teardrop-shaped structures, each composed of a portion of an isosceles triangular shape with a vertical angle of a desired value and an arc of a circle inscribed in the isosceles triangle, arranged with their apexes facing each other.

* * * * *

UNITED STATES PATENT AND TRADEMARK OFFICE

CERTIFICATE OF CORRECTION

PATENT NO. : 7,358,918 B2
APPLICATION NO. : 11/230821
DATED : April 15, 2008
INVENTOR(S) : Itsuji It is certified that error appears in the above-identified patent and that said Letters Patent is hereby corrected as shown below:

COLUMN 2:
Line 3, "desired the" should read -- the desired --.

COLUMN 7:
Line 18, "wave." should read -- wave --.

COLUMN 8:
Line 7, "distanced" should read -- distance d --.

COLUMN 9:
Line 47, "name)" should read -- name). --.

COLUMN 12:
Line 24, Delete "an" (second occurrence).

COLUMN 15:
Line 5, Delete "conductor comprises a" (second occurrence).

Signed and Sealed this

Twenty-second Day of December, 2009

David J. Kappos

David J. Kappos
*Director of the United States Patent and Trademark Office*